US005325086A

United States Patent [19]

Thomas

[11] Patent Number: 5,325,086

[45] Date of Patent: Jun. 28, 1994

[54] WAVE RESPONSIVE ALARM FOR SWIMMING POOL

[76] Inventor: Raymond F. Thomas, 6026 Curson Dr., Toledo, Ohio 43612

[21] Appl. No.: 699,504

[22] Filed: May 14, 1991

[51] Int. Cl.[5] ..... G08B 21/00

[52] U.S. Cl. ..... 340/620; 340/522; 340/565; 340/666

[58] Field of Search ..... 340/565-566, 340/541, 573, 665-666, 620, 669, 690, 522, 652; 200/85 R, 86.5, 512; 73/290 R, 307, 304 R; 307/131

[56] References Cited

U.S. PATENT DOCUMENTS

| | | | |
|---|---|---|---|
| 2,723,390 | 11/1955 | Robertson | 340/565 |
| 2,774,058 | 12/1956 | Raichel | 340/565 |
| 2,780,693 | 2/1957 | McClellan | 200/86 R |
| 3,001,184 | 9/1961 | Edelman | 340/565 |
| 3,058,101 | 10/1962 | Malvini | 340/565 |
| 3,092,822 | 6/1963 | Dorman | 340/565 |
| 3,204,232 | 8/1965 | Meyer | 340/565 |
| 3,482,237 | 12/1969 | Hamburg et al. | 340/566 |
| 3,696,372 | 10/1972 | Garrett et al. | 340/666 X |
| 3,696,546 | 10/1972 | Ambrose | 340/652 X |
| 3,732,556 | 5/1973 | Caprillo et al. | 340/566 |
| 3,757,318 | 9/1973 | Brisson | 340/565 |
| 3,803,573 | 4/1974 | Schonger | 340/565 |
| 3,953,843 | 4/1976 | Codina | 340/566 X |
| 4,099,406 | 7/1978 | Fulkerson | 73/304 R X |
| 4,189,722 | 2/1980 | Lerner | 367/93 |
| 4,203,097 | 5/1980 | Manning | 340/566 |
| 4,311,889 | 1/1982 | Blanchard et al. | 200/52 R |
| 4,333,094 | 6/1982 | Osborne | 340/566 |
| 4,408,193 | 10/1983 | Millen | 340/566 |
| 4,533,907 | 8/1985 | Thatcher | 340/565 |
| 4,797,661 | 1/1989 | Wiley | 340/669 X |
| 5,058,421 | 10/1991 | Alexander et al. | 340/620 X |

FOREIGN PATENT DOCUMENTS

| | | | |
|---|---|---|---|
| 1471795 | 3/1967 | France | 340/620 |

*Primary Examiner*—Thomas Mullen

*Attorney, Agent, or Firm*—MacMillan, Sobanski & Todd

[57] ABSTRACT

A safety device which is responsive to excessive wave motion of a body of water includes a housing having a pivotable telescoping arm connected thereto. A pair of spaced apart probes are mounted on the end of the arm. The probes are connected to a control circuit located in the housing. The control circuit measures the electrical resistance between the two probes, which is normally an open circuit. In use, the arm is manipulated so as to position the probes a desired distance above the normal water level when no one is in the pool. Thus, the space separating the two probes is normally not bridged by water from the pool. When a person enters the pool, however, larger waves are created. These larger waves splash across the probes, bridging the space therebetween. As a result, the electrical resistance between the probes decreases. The control circuit is responsive to this change for generating an alarm. The safety device may also include a pressure responsive switch secured to a step of a ladder in the pool. The pressure switch is also connected by wires to the control circuit. When a person using the ladder steps on the pressure switch, the control circuit is activated to generate the alarm.

18 Claims, 2 Drawing Sheets

WAVE RESPONSIVE ALARM FOR SWIMMING POOL

BACKGROUND OF THE INVENTION

This invention relates in general to safety devices and in particular to a device which is responsive to excessive wave motion of water in swimming pools and the like for generating an alarm.

Many homeowners enjoy the convenience of a swimming pool or similar body of water on their property. Although swimming pools provide obvious recreational benefits when used properly, they also represent a source of potential danger, especially to children who use the pool without permission and without adult supervision. To prevent accidental entry and to minimize unauthorized use, pools are commonly enclosed by a fence or similar barrier. Unfortunately, older children are often capable of climbing such fences or otherwise gaining access to the pool. Thus, it would be desirable to provide a device which can detect when the pool is in use and generate an alarm in response thereto.

Many safety devices are known which are responsive to wave motion for generating an alarm indicating that a pool or similar body of water is being used. Such devices operate on the theory that excessive waves are created in the pool by movement of a person in the water. When such waves are sensed, an alarm is generated. Unfortunately, many of these devices are complicated, expensive, or difficult to use. Thus, pool owners frequently do not obtain these safety devices for use with their pools. It would be desirable, therefore, to provide an improved wave responsive alarm which is simple and inexpensive in construction and operation.

Furthermore, some of the known wave responsive devices are not easily adjustable for use under differing weather conditions. For example, it is known that some waves are naturally created when the wind blows, even when no person is in the pool. On very windy days, these waves are larger than on calm days. Known wave responsive devices are not readily adjustable to compensate for the larger waves naturally encountered on windy days. As a result, such devices generate false alarms or, because of the likelihood of such false alarms, are not used at all. Accordingly, it would also be desirable to provide a wave responsive safety device which is easily adjustable for use under different weather conditions.

SUMMARY OF THE INVENTION

This invention relates to a simple and inexpensive safety device which is responsive to excessive wave motion of water in swimming pools and the like for generating an alarm. The device includes a housing having a pivotable telescoping arm connected thereto. A pair of spaced apart probes are mounted on the end of the arm. The probes are connected to a control circuit located in the housing. The control circuit measures the electrical resistance between the two probes, which is normally an open circuit. In use, the arm is manipulated so as to position the probes a desired distance above the normal water level when no one is in the pool. Thus, the space separating the two probes is normally not bridged by water from the pool. When a person enters the pool, however, larger waves are created. These larger waves splash across the probes, bridging the space therebetween. As a result, the electrical resistance between the probes decreases. The control circuit is responsive to this change for generating an alarm. The safety device may also include a pressure responsive switch secured to a step of a ladder in the pool. The pressure switch is also connected to the control circuit. When a person using the ladder steps on the pressure switch, the control circuit is activated to generate the alarm.

It is an object of this invention to provide an improved safety device which is responsive to excessive wave motion of water in swimming pools and the like for generating an alarm.

It is another object of this invention to provide such a wave responsive safety device which is easily adjustable for use under different weather conditions.

It is a further object of this invention to provide such a swimming pool safety device which is simple and inexpensive in operation and construction.

Other objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
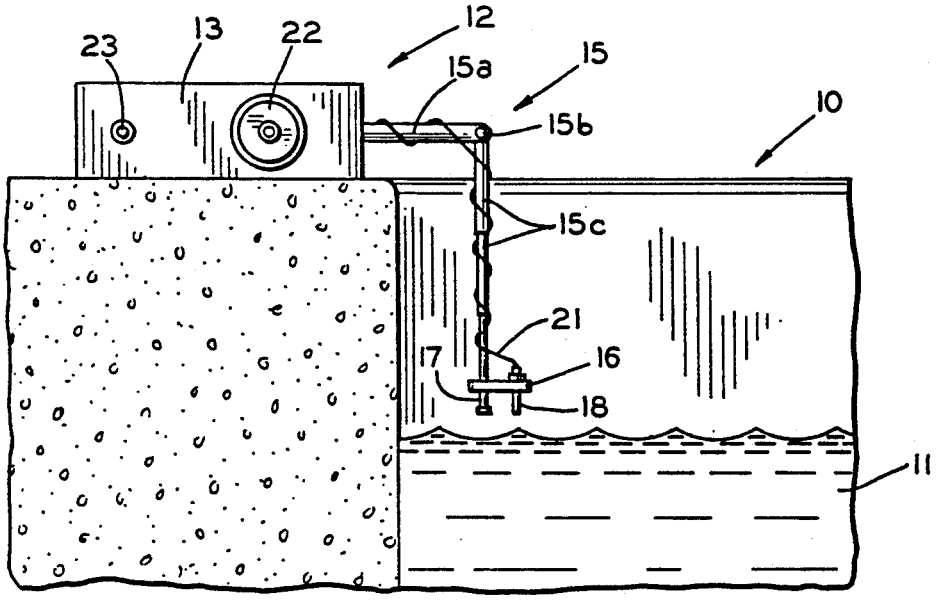
FIG. 1 is a side elevational view of a portion of a swimming pool having a wave responsive safety device in accordance with this invention located on the edge thereof, the water in the swimming pool being shown in a relatively calm condition which is typical of when a person is not using the pool.
Figure 2:
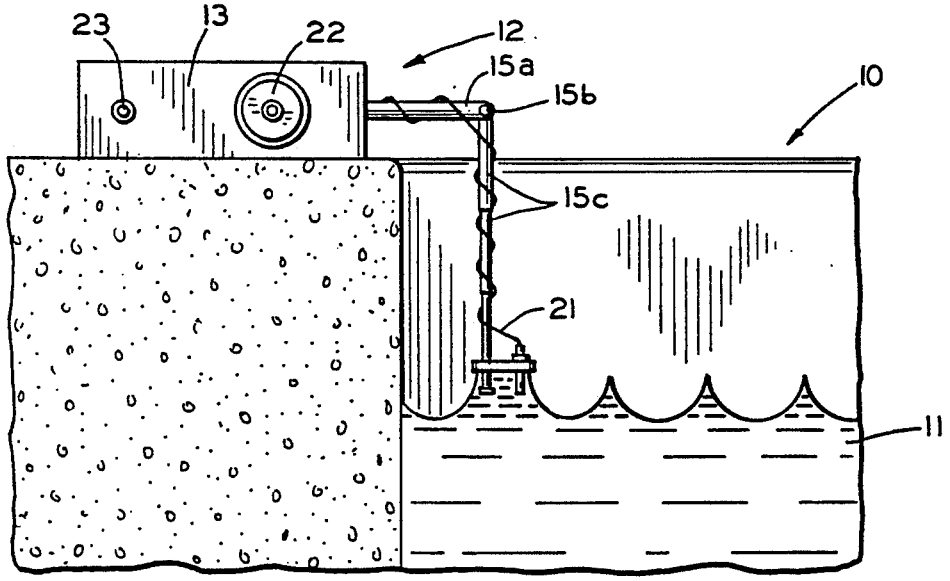
FIG. 2 is a side elevational view similar to FIG. 1 wherein the water in the pool is shown in a relatively agitated condition which is typical of when a person is using the pool.

Referring now to the drawings, there is illustrated in FIGS. 1 and 2 a portion of a conventional swimming pool 10 having a quantity of water 11 contained therein. A safety device in accordance with this invention, indicated generally at 12, is positioned on the edge of the pool. As will be explained in greater detail below, the safety device 12 is responsive to excessive wave motion caused by usage of the pool for generating an alarm. Although this invention will be described and illustrated in the context of a swimming pool 10, it will be appreciated that the safety device 12 can be used to monitor any similar body of water.

The safety device 12 includes a housing 13 having an adjustable arm, indicated generally at 15, connected thereto. In the illustrated embodiment, the adjustable arm 15 includes an end section 15*a* which is connected through a pivotable joint 15*b* to one of a plurality of telescoping sections 15*c*. The end section 15*a* is supported in the housing 13 for rotation about its longitudinal axis. The telescoping sections 15c may be extended and retracted to adjust the effective length thereof. Thus, it can be seen that the arm 15 can be rotated to any angle relative to the housing 13, and that the length of the arm 15 can be extended and retracted as desired. The overall arm 15 can be formed from the same structure which is often used to form an antenna for a portable radio.

A bracket 16 is mounted on the end of the arm 15. The bracket 16 is formed from an electrically non-conductive material, for reasons which will become apparent below. A pair of spaced apart probes 17 and 18 are secured to the bracket 16. For reasons which will also be explained in detail below, the probes 17 and 18 are positioned a short distance above the surface of the water 11 in the pool 10. The above-described structure of the adjustable arm 15 permits this positioning of the probes 17 and 18 to be accomplished quickly and easily.

To install the device 12 for use, the adjustable arm 15 is initially rotated, pivoted, and extended such that the probes 17 and 18 are positioned a short distance above the normal level of the waves in the water 11 of the pool 10, as show in FIG. 1. The magnitude of this distance is dependent upon the prevailing weather conditions. For example, if the wind is calm, the waves in the pool 10 caused thereby will be relatively small. Thus, the probes 17 and 18 miry be positioned a very short distance above the level of the water 11. If the wind is strong, the waves caused thereby will be larger. Consequently, the probes 17 and 18 will be positioned somewhat higher above the level of the water 11. It has been found desirable to position the probes 17 and 18 about one-half to one inch above the surface of the water 11 under normal weather conditions. This distance normally prevents the water 11 from bridging the gap separating the probes 17 and 18 when the pool 10 is not in use (as shown in FIG. 1), but normally permits such bridging to occur when a person is in the pool 10 (as shown in FIG. 2).

The device 12 is designed to generate an alarm when water 11 bridges the gap separating the probes 17 and 18. By properly positioning the probes 17 and 18 relative to the surface of the water 11, such bridging will occur only when a person is in the pool 10. To accomplish this, the probes 17 and 18 are connected through respective electrical conductors to a control circuit 20 (see FIG. 3) contained within the housing 13. One of the electrical conductors may be a wire 21, which is shown in FIGS. 1 and 2 as being connected to the probe 18. The other electrical conductor may be the adjustable arm 15 itself, assuming that the arm is formed from a metallic material.

The control circuit 20 measures the electrical resistance between the two probes 17 and 18. Normally, such resistance is very large (effectively an open circuit) because the probes 17 and 18 are spaced apart from one another by the non-conductive bracket 16. However, when relatively large waves are present in the pool 10, the water 11 bridges the gap between the two probes 17 and 18. As a result, the electrical resistance between the probes 17 and 18 decreases dramatically. The control circuit 20 is responsive to this change in electrical resistance for activating an alarm 22. The alarm 22 may be embodied as an audible alarm, such as a horn or a siren, or it may be a visual alarm, such as a flashing light. Preferably, the alarm 22 is contained within the housing 13, as shown. However, the control circuit 20 may be connected to a remote alarm (not shown), such as located within the house of the owner of the pool 10.

Preferably once it is triggered as described above, the control circuit 20 continues to activate the alarm 22 until a manual reset switch 23 is closed. In other words, the control circuit 20 functions in the nature of a latch when the alarm 22 is activated, continuing such activation even after the relatively large waves have stopped. The control circuit 20 can be constructed from conventional electrical components, and a person having ordinary skill in the art would be able to construct the control circuit 20 using readily available technology.

Figure 3:
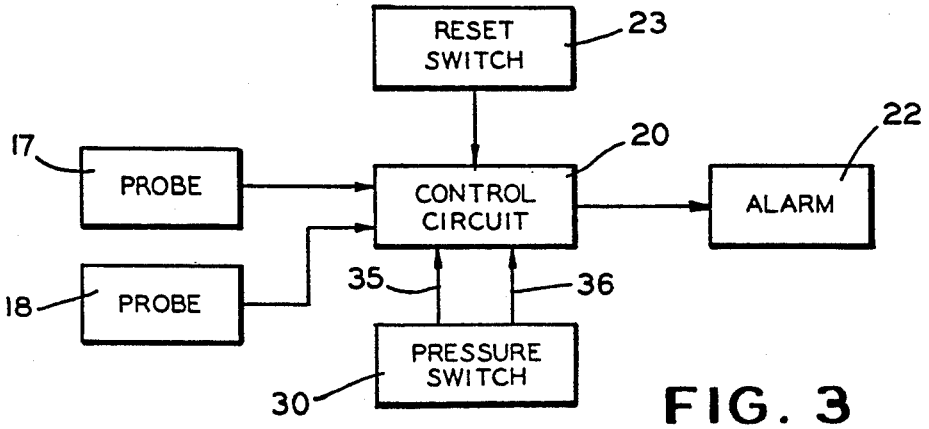
FIG. 3 is a block diagram of an electrical control circuit for the safety device illustrated in FIGS. 1 and 2.
Figure 4:
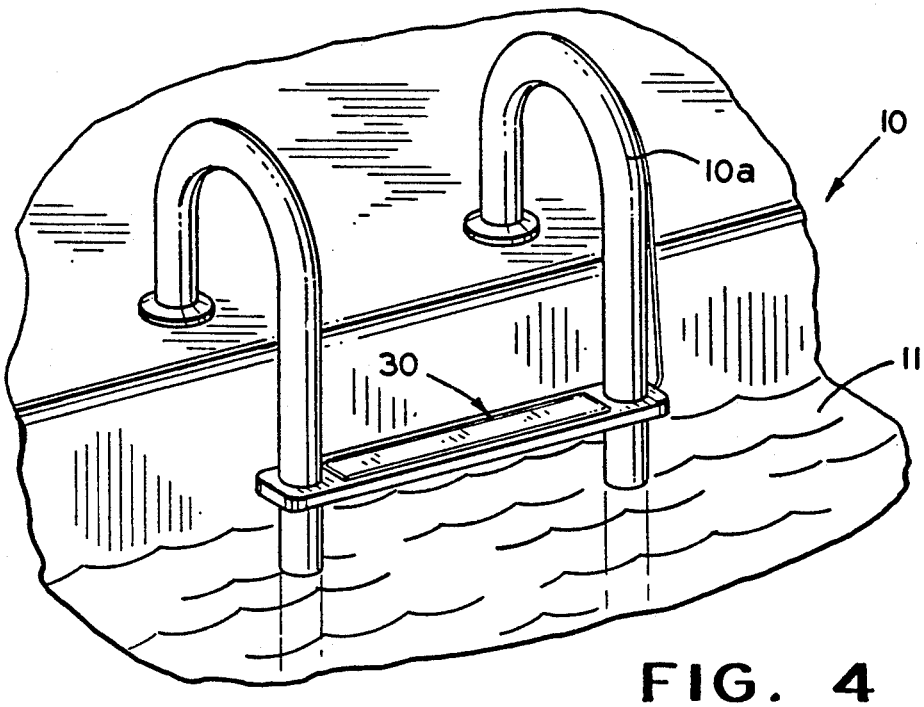
FIG. 4 is perspective view of a portion of a ladder for the pool illustrated in FIG. 1 having a pressure responsive switch in accordance with this invention secured to one step thereof.
Figure 5:
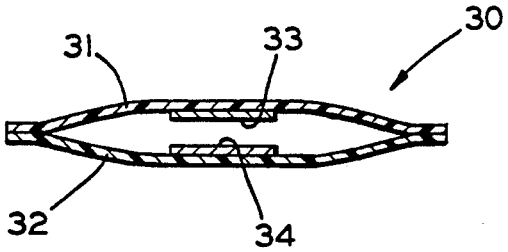
FIG. 5 is a sectional elevational view of the pressure responsive switch shown in FIG. 4.

Referring now to FIG. 4, there is illustrated a conventional ladder 10a which is secured to the side of the pool 10 to facilitate entry and exit. The ladder 10a includes a plurality of steps, only one of which is illustrated. A pressure responsive switch, indicated generally at 30, is secured to one of the steps of the ladder 10a. As best shown in FIG. 5, the switch 30 is formed from a pair of slightly curved, deformable plastic members 31 and 32. The members 31 and 32 are oriented such that the concave sides thereof face toward each other, defining an internal longitudinally extending space. The longitudinal edges of the members 31 and 32 are secured together by any conventional means, such as adhesive. A pair of metallic strips 33 and 34 are secured to the inner surfaces of the members 31 and 32, respectively. The metallic strips 33 and 34 are connected to the control circuit 30 by respective electrical conductors 35 and 36, as shown in FIG. 3.

Because of the inherent curved shape of the members 31 and 32, the metallic strips 33 and 34 are normally maintained in the spaced apart relationship illustrated in FIG. 5. Thus, the electrical resistance therebetween is relatively high, even through water 11 in the pool 10 may fill the cavity therebetween. However, when a person using the ladder 10a steps on the pressure switch 30, the members 31 and 32 are deformed toward each other. As a result, the metallic strips 33 and 34 are moved into contact with one another. Such contact causes the electrical resistance between the metallic strips 33 and 34 to drop dramatically to virtually zero. The control circuit 20 is responsive to this decrease in the electrical resistance to activate the alarm 22, as described above.

Figure 6:
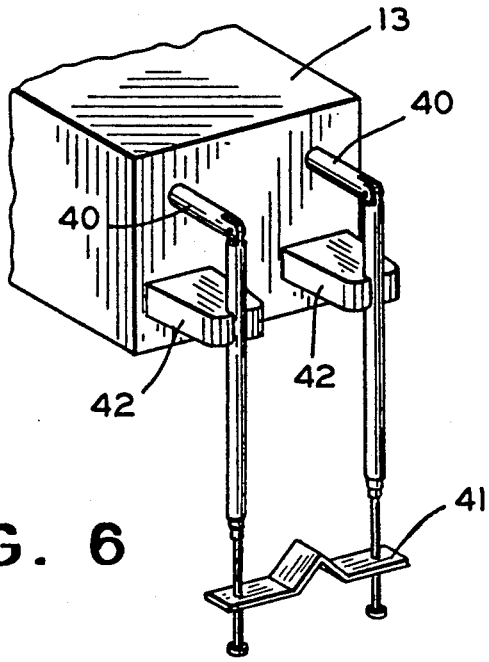
FIG. 6 is a perspective view of a second embodiment of the means for positioning the probes relative to the surface of the water for the device illustrated in FIGS. 1 and 2.

Referring now to FIG. 6, there is illustrated a second embodiment of the means for positioning the probes 17 and 18 relative to the surface of the water 11. As shown therein, this positioning means includes a pair of adjustable arms 40. The structures of the arms 40 are identical, each including an end section connected through a pivotable joint to one of a plurality of telescoping sections, similar to the arms 15 described above. The probes 17 and 18 are respectively connected to the ends of the arms 40 and may be embodied as the electrically conductive arms 40 themselves. The ends of the two arms 40 may be connected together by a bracket 41 to facilitate movement together. The bracket 41 is preferably formed from a rigid, electrically non-conductive material, such as plastic. Thus, when the arms 40 are moved as described above, the ends of the arms supporting the probes 17 and 18 are, maintained in a predetermined spaced apart relationship. The central portion of the bracket 41 is preferably formed having an angled shape to prevent water from gathering thereon and inadvertently bridging the gap separating the probes 17 and 18, thus causing the alarm 22 to be falsely activated.

A pair of stabilizers 42 are mounted on the side of the housing 13 for releasably retaining the arms 40 in a desired position relative to the housing. The stabilizers 42 can be formed from a deformable plastic material having recesses formed therein. When the arms 40 are pivoted downwardly, portions thereof are received within the recesses of the stabilizers 42. The recesses may be formed such that the arms 40 are received therein in a snap fit relationship which prevents removal unless an appropriate force is exerted thereon. The stabilizers 42 prevent the arms from being inadvertently moved during use.

In accordance with the provisions of the patent statutes, the principle and mode of operation of the invention have been described and illustrated in its preferred embodiments. However, it must be understood that the invention may be practiced otherwise than as specifically explained and illustrated without departing from its spirit or scope.

What is claimed is:

1. A device for generating an alarm in response to excessive wave motion in a body of water comprising:

a housing;

a pair of spaced apart probes defining a space therebetween;

adjustable arm means connected between said housing and said probes for supporting said probes at a predetermined position relative to said housing, whereby said probes are positioned a predetermined distance above the surface of the body of water such that water bridges said space only when excessive wave motion occurs;

a pressure responsive switch for generating a signal when a predetermined pressure is applied thereto; and control circuit means responsive to a change in the electrical resistance between said probes caused by water bridging said space for generating an alarm and responsive to said pressure responsive switch signal for generating an alarm.

2. The invention defined in claim 1 wherein said adjustable arm means includes an adjustable arm having both of said probes supported on the end thereof.

3. The invention defined in claim 2 wherein said adjustable arm includes a plurality of telescoping sections.

4. The invention defined in claim 3 wherein said adjustable arm further includes a rotatable end section connected to one of said telescoping sections by a pivot joint.

5. The invention defined in claim 2 wherein said means for positioning includes a bracket supported on the end of said adjustable arm and wherein said probes are supported on said bracket.

6. The invention defined in claim 2 wherein said adjustable arm is formed from an electrically conductive material and is connected between one of said probes and said control circuit means to function as an electrical conductor therebetween.

7. The invention defined in claim 1 wherein said adjustable arm means includes a pair of adjustable arms, each having one of said probes supported on the end thereof.

8. The invention defined in claim 7 wherein each of said adjustable arms includes a plurality of telescoping sections.

9. The invention defined in claim 8 wherein each of said adjustable arms further includes a rotatable end section connected to one of said telescoping sections by a pivot joint.

10. The invention defined in claim 7 wherein said means for positioning further includes a bracket connected to each of said adjustable arms.

11. The invention defined in claim 10 wherein said bracket is formed having a central angled region to prevent water from accumulating thereon.

12. The invention defined in claim 7 wherein each of said adjustable arms is formed from an electrically conductive material, said adjustable arms being respectively connected between said probes and said control circuit means to function as an electrical conductor therebetween.

13. The invention defined in claim 1 wherein said pressure responsive switch includes a pair of curved, deformable plastic members having concave sides which face toward each other so as to define an internal space and a pair of metallic strips secured to said concave sides of said members within said internal space.

14. A device for generating an alarm in response to excessive wave motion in a body of water comprising:

a housing;

a pair of spaced apart probes defining a space therebetween;

adjustable arm means connected between said housing and said probes for supporting said probes at a predetermined position relative to said housing, said adjustable arm means permitting at least two of pivoting, telescoping, and rotating movement of said probes relative to said housing, whereby said probes are positioned a predetermined distance above the surface of the body of water such that water bridges said space only when excessive wave motion occurs; and control circuit means responsive to a change in the electrical resistance between said probes caused by water bridging said space for generating an alarm.

15. The invention defined in claim 14 wherein said adjustable arm means permits pivoting and rotating movement of said probes relative to said housing.

16. The invention defined in claim 14 wherein said adjustable arm means permits pivoting and telescoping movement of said probes relative to said housing.

17. The invention defined in claim 14 wherein said adjustable arm means permits rotating and telescoping movement of said probes relative to said housing.

18. The invention defined in claim 14 wherein said adjustable arm means permits pivoting, rotating, and telescoping movement of said probes relative to said housing.

* * * * *